US009994925B2

(12) United States Patent
Shouji et al.

(10) Patent No.: US 9,994,925 B2
(45) Date of Patent: Jun. 12, 2018

(54) COLD WORK TOOL MATERIAL, COLD WORK TOOL AND METHOD FOR MANUFACTURING SAME

(71) Applicant: HITACHI METALS, LTD., Tokyo (JP)

(72) Inventors: Tatsuya Shouji, Yasugi (JP); Yukio Shinji, Yasugi (JP); Katsufumi Kuroda, Yasugi (JP)

(73) Assignee: HITACHI METALS, LTD., Tokyo (JP)

( * ) Notice: Subject to any disclaimer, the term of this patent is extended or adjusted under 35 U.S.C. 154(b) by 0 days. days.

(21) Appl. No.: 15/517,618

(22) PCT Filed: Jan. 7, 2016

(86) PCT No.: PCT/JP2016/050289
§ 371 (c)(1),
(2) Date: Apr. 7, 2017

(87) PCT Pub. No.: WO2016/125523
PCT Pub. Date: Aug. 11, 2016

(65) Prior Publication Data

US 2017/0314086 A1 Nov. 2, 2017

(30) Foreign Application Priority Data

Feb. 4, 2015 (JP) ..... 2015-020168

(51) Int. Cl.
*C22C 38/22* (2006.01)
*C22C 38/24* (2006.01)
(Continued)

(52) U.S. Cl.
CPC ..... *C21D 7/13* (2013.01); *B21J 13/02* (2013.01); *C21D 6/002* (2013.01); *C21D 8/005* (2013.01);
(Continued)

(58) Field of Classification Search
None
See application file for complete search history.

(56) References Cited

U.S. PATENT DOCUMENTS

2006/0157163 A1 7/2006 Shimizu et al.

FOREIGN PATENT DOCUMENTS

JP 5-140699 A 6/1993
JP 11-310820 A 11/1999
(Continued)

OTHER PUBLICATIONS

Japanese Notification of Reasons for Refusal for Application No. 2016-573241 drafted Feb. 9, 2017 and dated Feb. 14, 2017, 6 pages total (including translation).
(Continued)

*Primary Examiner* — Deborah Yee
(74) *Attorney, Agent, or Firm* — Sughrue Mion, PLLC

(57) ABSTRACT

Provided is a cold work tool material capable of reducing dimensional changes which occur, due to heat treatment, in the longitudinal direction of the material during quenching and tempering. This cold work tool material is drawn through hot working, has an annealed structure including carbides, and is used after being quenched and tempered, wherein, in the annealed structure which is formed in a cross section parallel to a drawing direction due to the hot working of the cold work tool material, the standard deviation in the degree of orientation of carbides Oc, as determined by equation (1) below, is 6.0 or more for carbides having a circle equivalent diameter of 5.0 μm or greater as observed in the annealed structure in the cross section at right angle to a direction perpendicular to the drawing direction. $Oc=D\times\theta$ . . . (1), where D represents the circle equivalent diameter (μm) of the carbide, and θ represents the angle (rad) between the major axis of an approximate ellipse of the
(Continued)

carbide and the drawing direction. A cold work tool using the cold work tool material and a method for manufacturing the same are also provided.

5 Claims, 10 Drawing Sheets

(51) Int. Cl.

| | |
|---|---|
| ***C22C 38/44*** | (2006.01) |
| ***C22C 38/46*** | (2006.01) |
| ***C21D 7/13*** | (2006.01) |
| ***C21D 8/00*** | (2006.01) |
| ***C21D 6/00*** | (2006.01) |
| ***B21J 13/02*** | (2006.01) |

(52) U.S. Cl.
CPC ..... *C22C 38/22* (2013.01); *C22C 38/24* (2013.01); *C21D 2211/008* (2013.01)

(56) References Cited

FOREIGN PATENT DOCUMENTS

| | | | |
|---|---|---|---|
| JP | 2001-200341 | A | 7/2001 |
| JP | 2001-294974 | A | 10/2001 |
| JP | 2006-193790 | A | 7/2006 |
| JP | 2009-132990 | A | 6/2009 |

OTHER PUBLICATIONS

International Search Report of PCT/JP2016/050289 dated Apr. 5, 2016.

COLD WORK TOOL MATERIAL, COLD WORK TOOL AND METHOD FOR MANUFACTURING SAME

CROSS REFERENCE TO RELATED APPLICATIONS

This application is a National Stage of International Application No. PCT/JP2016/050289 filed Jan. 7, 2016 (claiming priority based on Japanese Patent Application No. 2015-020168 filed Feb. 4, 2015), the contents of which are incorporated herein by reference in their entirety.

TECHNICAL FIELD

The present invention relates to a cold work tool material suitable for various kinds of cold work tools such as a press die, forging die, rolling die or a cutting tool. The present invention also relates to a cold work tool made of the material and to a method for manufacturing the tool.

BACKGROUND ART

Since a cold work tool is used in contact with a hard workpiece, the tool is required to have a sufficient hardness and wear resistance to resist the contact. Conventionally, alloy tool steels, such as SKD10 or SKD11 series pursuant to the JIS, have been used for a cold work tool material.

Typically, a cold work tool material is manufactured from a raw material, as a starting material in a form of an ingot or a bloom which is produced from the ingot. The starting material is subjected to various hot workings and heat treatments to produce a predetermined steel material, and then the steel material is subjected to an annealing process to produce a final material. Typically, the material in the annealed condition having a low hardness is supplied to a manufacturer of a cold work tool. The material supplied to the manufacturer is machined into a shape of the tool by cutting, boring or the like, and thereafter quenched and tempered to adjust it to have a predetermined hardness for use. After the adjustment of the hardness, finishing machining is typically conducted. Here, the term "quenching" refers to an operation for heating a cold work tool material, after machined in a shape of the tool, at an austenitic phase temperature range and then rapidly cooling it to transform a structure thereof into a martensitic structure. Thus, the material has such a composition that can have a martensitic structure by quenching.

In this connection, "dimensional change through heat treatment" may occur in the cold work tool material. The "dimensional change through heat treatment" means a volume (dimension) change between before and after the quenching and tempering. Particularly, the dimensional change in a direction extended by hot working (that is, in a longitudinal direction of the material) is an expanding change that occurs through the quenching, and the expansion is largest in the direction. If the large expansion occurs in the longitudinal direction of the material, dimensional control by tempering becomes difficult. Typically, the cold work tool material shrinks through a low temperature tempering, while it expands through a high temperature tempering. Thus, the tempering is conducted at a temperature where the dimensional change becomes nearly zero relative to the annealed material, when the dimensional change should be controlled for the cold work tool. However, the large expansion in the longitudinal direction (that is anisotropic to width and thickness directions) during quenching is hardly cancelled by the tempering step. Therefore, it is required to design a complicated "cutting allowance" for finish machining of the shape before the quenching and tempering. If the expansion in the longitudinal direction is too large, adjustment by the "cutting allowance" becomes impossible.

A cold work tool material including a reduced amount of large carbides have been proposed to the problem, on assumption that the dimensional change through heat treatment occurs due to the large carbides in a structure of the material. For example, JP-A-2001-294974 proposes a cold work tool material having a cross-sectional structure in which carbides having an area of 20 $\mu m^2$ or larger occupy an area ratio of 3% or less after quenching and tempering (see Patent Literature 1). Also, JP-A-2009-132990 proposes a cold work tool material having a cross-sectional structure parallel to an direction extended by hot working, in which carbides having a circle equivalent diameter of 2 μm or greater have an area ration of 0.5% or less before quenching and tempering, for the purpose of suppressing the expansion in the longitudinal direction (see Patent Literature 2).

CITATION LIST

Patent Literature

Patent Literature 1: JP-A-2001-294974
Patent Literature 2: JP-A-2009-132990

SUMMARY OF INVENTION

The cold work tool materials of Patent Literatures 1 and 2 are excellent in suppressing the dimensional change through quenching and tempering. However, the cold work tool materials of Patent Literatures 1 and 2 are designed to reduce an amount of large carbides causing the dimensional change, their compositions are adjusted to include low carbon and chromium contents. Thus, a volume ratio of carbides is reduced so that a wear resistance is reduced. In order to maintain an excellent wear resistance, the composition of the material should include "high carbon and chromium contents" as high as those of SKD10 or SKD11, although there has been a problem that the dimensional change was increased, and particularly large expansion occurs in the longitudinal direction.

An object of the present invention is to provide a cold work tool material that generate reduced dimensional change in a direction extended by hot working or in a longitudinal direction of the material, through quenching and tempering of the material while the material has the "high carbon and chromium" composition. Another object is to provide a cold work tool made of the material. It is also an object to provide a method for producing the tool.

The present invention provides a cold work tool material having an annealed structure extended by hot working and including carbides. The material is to be quenched and tempered for use. The material has a composition adjustable to have a martensitic structure by the quenching, and includes, by mass %, C: 0.80% to 2.40%, Cr: 9.0% to 15.0%, Mo and W alone or in combination in an amount of (Mo+½W): 0.50% to 3.00%, and V: 0.10% to 1.50%. In viewing the annealed structure of the cold work tool material in a cross section parallel to a direction extended by the hot working and perpendicular to a transverse direction, carbides having a circle equivalent diameter of not less than 5.0 μm have a standard deviation of a carbide orientation degree Oc being not less than 6.0, wherein the carbide orientation degree Oc is determined by following equation (1):

$$Oc=D*\theta \quad (1),$$

where D represents a circle equivalent diameter, by μm, of a carbide, and θ represents an angle, by radian, between the extended direction and a major axis of an approximate ellipse of the carbide.

The present invention also provides the cold work tool material described above, wherein carbides having a circle equivalent diameter of not less than 5.0 μm have a standard deviation of a carbide orientation degree Oc determined by the equation (1) being not less than 10.0, in viewing the annealed structure of the cold work tool material in a cross section parallel to the direction extended by the hot working and perpendicular to a normal direction.

The present invention also provides a cold work tool having a martensitic structure including carbides. The martensitic structure has been formed by quenching and tempering an annealed structure that had been extended by hot working. The cold work tool has a composition adjustable to have the martensitic structure by the quenching, and includes, by mass %, C: 0.80% to 2.40%, Cr: 9.0% to 15.0%, Mo and W alone or in combination in an amount of (Mo+½W): 0.50% to 3.00%, and V: 0.10% to 1.50%.

In viewing the martensitic structure of the cold work tool in a cross section parallel to a direction extended by the hot working and perpendicular to a transverse direction, carbides having a circle equivalent diameter of not less than 5.0 μm have a standard deviation of a carbide orientation degree Oc being not less than 6.0, wherein the carbide orientation degree Oc is determined by following equation (1):

$$Oc=D*\theta \quad (1),$$

where D represents the circle equivalent diameter, by μm, of a carbide, and θ represents an angle, by radian, between the extended direction and a major axis of an approximate ellipse of the carbide.

The present invention also provides the cold work tool described above, wherein carbides having a circle equivalent diameter of not less than 5.0 μm have a standard deviation of a carbide orientation degree Oc determined by the equation (1) being not less than 10.0, in viewing the martensitic structure of the tool in a cross section parallel to the direction extended by the hot working and perpendicular to a normal direction.

The present invention also provides a method for manufacturing a cold work tool, including a step of quenching and tempering the above cold work tool material.

Advantageous Effects of Invention

According to the present invention, it is possible to reduce the dimensional change in the direction extended by the hot working or in the longitudinal direction, which occurs in quenching and tempering the cold work tool material having the composition of "high carbon and chromium" contents.

DESCRIPTION OF EMBODIMENTS

Figure 1:
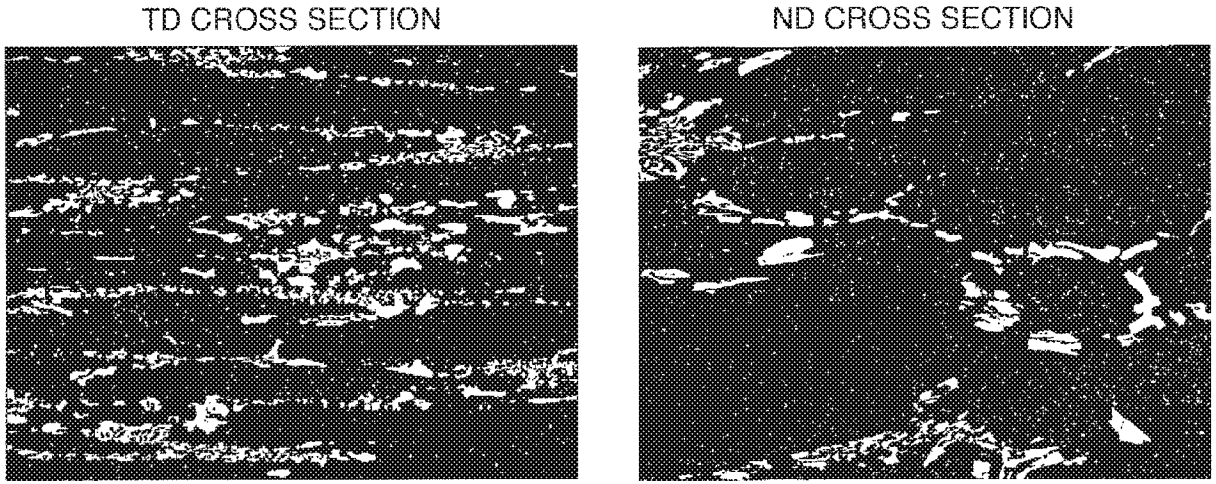
FIG. 1 is a view of an image binarizing an optical microscope photograph of a cross-sectional structure of a cold work tool material of an example according to the present invention to show an example of carbides distributed in the cross-sectional structure.

The present inventors investigated a dimensional change which occurs during a heat treatment of a cold work tool material, such as SKD10 or SKD11, having a composition of "high carbon and chromium" contents, particularly factors affecting a dimensional expansion in the extended direction. Here, the "extended direction" is defined as a direction in which the material is extended and elongated by an applied load during hot working of the material. Therefore, the extended direction is also referred to as a "longitudinal direction of the material". A direction of applying the load is a thickness direction of the material. Furthermore, a direction orthogonal to the longitudinal direction and to the thickness direction is referred to as a width direction or a transverse direction".

As a result of the investigation, it was found that a level of "orientation degree" of "non-soluted carbides" in the longitudinal direction of the material affects the dimensional expansion in the longitudinal direction. The "non-soluted carbides" have existed in an annealed structure before quenched and tempered and remains non-soluted in a matrix after quenched and tempered. It was further found that the dimensional expansion in the longitudinal direction can be reduced by controlling the level of the "orientation degree" of the non-soluted carbides, even though the non-soluted carbides were not miniaturized (namely, the large carbides were not reduced). Thus, they reached the present invention. Each component of the present invention will be described below.

(i) The cold work tool of the present invention "having an annealed structure extended by hot working and including carbides, the material being to be quenched and tempered for use".

As described above, a cold work tool material is manufactured from a raw material as a starting material, such as an ingot or a bloom which is produced from the ingot, through various hot workings and heat treatments to form a predetermined steel material, and finally by annealing the steel material. The annealed structure is defined as a structure obtained by an annealing process, and is preferably softened to have a Brinnel hardness of about 150 to about 230 HBW. Typically, the annealed structure has a ferrite phase, or a ferrite phase with pearlite or cementite ($Fe_3C$). The annealed structure is an extended structure by the hot working. The annealed structure of the cold work tool material typically includes carbides of Cr, Mo, W, V or the like bonded with carbon. Among these carbides, larger carbides become non-soluted carbides which do not solid-soluted in a matrix in a subsequent quenching step. The non-soluted carbides distribute to have a predetermined degree of orientation in relation to a longitudinal direction of the material through the extension by the hot working (described later).

(ii) The cold work tool material of the present invention "has a composition adjustable to have a martensitic structure by the quenching, and comprising, by mass %, C: 0.80% to 2.40%, Cr: 9.0% to 15.0%, Mo and W alone or in combination in an amount of (Mo+½W): 0.50% to 3.00%, and V: 0.10% to 1.50%".

As described above, a raw material of the cold work tool material transforms into a martensitic structure through quenching and tempering. The martensitic structure is necessary for providing the cold work tool with various mechanical properties. Various cold work tool steels, for example, are representative as such a raw material. The cold work tool steels are used in an environment where a surface temperature is not higher than about 200° C. It is important in the present invention to employ a composition of "high carbon and chromium" contents to obtain an excellent wear resistance, and standardized steel types such as SKD10 and SKD11 specified as "alloy tool steel" of JIS-G-4404 for example and other proposed compositions can be representatively employed. Other elements other than those specified in the above cold work tool steel can be added and included according to a necessity.

The effect of "reducing a dimensional expansion in a longitudinal direction of the material through quenching" (hereinafter referred to as "dimensional expansion reducing effect") of the present invention can be achieved if the annealed structure satisfies the requirement (iii) described later, as far as such raw material is used that generates the martensitic structure by quenching and tempering the annealed structure. In order to achieve both of the dimensional expansion reducing effect and a wear resistance which is the primary property of the cold work tool steel, it is effective to specify contents of carbon and carbide forming elements Cr, Mo, W and V in the compositions for generating the martensitic structure, since they contribute to increase of a volume ratio of carbides included in the cold work tool products. Particularly, it is important to make the carbon and chromium contents "higher" in order to impart the excellent wear resistance. Specifically, the composition comprises, by mass %, C: 0.80% to 2.40%, Cr: 9.0% to 15.0%, Mo and W alone or in combination in an amount of (Mo+½W): 0.50% to 3.00%, and V: 0.10% to 1.50%. Each element of the composition of the cold work tool material of the present invention is described as follows.

C: 0.80 to 2.40 Mass % ("Mass %" is Hereinafter Expressed as Merely "%")

Carbon is a basic element for the cold work tool material. Carbon partially solid-solutes in a matrix to make the matrix hard and partially forms carbides to improve a wear resistance and a seizure resistance. When substitutional atoms, such as Cr, with high affinity with carbon is added together with carbon solid-soluting as interstitial atoms, an I (interstitial atoms)-S (substitutional atoms) effect is also expected (which acts as the drag resistance of solid-soluted atoms and enhances a strength of the cold work tool). However, if excessive carbon is added, an amount of solid-soluted carbons increases in the quenching, which leads to increased expansion through martensitic transformation, and the thus dimensional changing ratio through quenching increases. Therefore, the carbon content is made 0.80 to 2.40%, preferably not less than 1.30%, or preferably not more than 1.80%.

Cr: 9.0 to 15.0%

Cr is an element that increases hardenability. Furthermore, Cr forms carbides to effect in improving a wear resistance. Cr is a basic element of the cold work tool material contributing also to improvement of a resistance to softening in tempering. However, excessive addition will cause formation of coarse non-soluted carbides and lead to deterioration in toughness. Therefore, a Cr content is made 9.0 to 15.0%, preferably not more than 14.0% or preferably not less than 10.0%, and more preferably not less than 11.0%.

Mo and W Alone or in Combination in an Amount of (Mo+½W): 0.50 to 3.00%

Mo and W are elements causing fine carbides to precipitate or aggregate in a structure through tempering, and thereby imparting a strength to the cold work tool. Mo and W may be added alone or in combination. The amount can be specified by a Mo equivalent that is defined by a formula of (Mo+½W) since an atomic weight of W is about twice of that of Mo. Of course, only one of them may be added or both may be added. To achieve the above effects, an amount of (Mo+½W) is made not less than 0.50%, preferably not less than 0.60%. Since excessive addition will cause deterioration of machinability and toughness, the amount of (Mo+½W) is not more than 3.00%, preferably not more than 2.00%, more preferably not more than 1.50%.

V: 0.10 to 1.50%

Vanadium forms carbides and has effects of strengthening a matrix and improving a wear resistance and a resistance to softening in tempering. Also, vanadium carbides distributed in an annealed structure function as "pinning particles" that suppress coarsening of austenite grains during heating for quenching, and thereby also contribute to improvement of toughness. To achieve the effects, a vanadium content is made not less than 0.10%, preferably not less than 0.20%. In the present invention, not less than 0.60% of vanadium may be added to improve the wear resistance. However, if excessive amount of vanadium is added, non-soluted large carbides are formed and the dimensional change through heat treatment is increased. Furthermore, excessive addition of vanadium also causes deterioration of machinability and toughness due to increase of the carbides themselves. Thus, the vanadium content is not more than 1.50%, preferably not more than 1.00%.

The cold work tool material of the present invention may have a composition including the above elements. Also, the composition may include the above elements and the balance of iron and inevitable impurities. In addition to the above elements, the material may also include following elements.

Si: Not More than 2.00%

Si is used as a deoxidizer in a melting process. Excessive amount of Si deteriorates hardenability, as well as toughness of the quenched and tempered tool. Thus, the Si content is preferably not more than 2.00%, more preferably not more than 1.50%, further more preferably not more than 0.80%. On the other hand, Si solid-solutes in the structure of the tool and has an effect of enhancing hardness of the tool. To obtain the effect, a Si content is preferably not less than 0.10%.

Mn: Not More than 1.50%

Excessive amount of Mn increases ductility of a matrix, and thereby deteriorates machinability of the material. Thus, an amount of Mn is preferably not more than 1.50%, more preferably not more than 1.00%, further more preferably not more than 0.70%. On the other hand, Mn is an austenite forming element, and it has an effect of enhancing hardenability. Moreover, Mn has a large effect of improving machinability since it forms non-metallic inclusions of MnS. To achieve the effects, an amount of Mn is preferably not less than 0.10%, more preferably not less than 0.20%.

P: Not More than 0.050%

Phosphor is an element inevitably included in various cold work tool materials even though it is not added. Phosphor segregates in prior austenite grain boundaries during a heat treatment such as tempering, thereby making the grain boundaries brittle. Therefore, it is preferable to limit a phosphor content, including a case of intentionally adding, to not more than 0.050% in order to improve toughness of the tool. More preferably, it is not more than 0.030%.

S: Not More than 0.0500%

Sulfur is an element inevitably included in various cold work tool materials even though it is not added. Sulfur deteriorates hot workability of a raw material before hot-worked, and producing cracks during the hot working. Therefore, it is preferable to limit a sulfur content to not more than 0.0500%, more preferably not more than 0.0300% in order to improve hot workability. On the other hand, sulfur has an effect of improving machinability by bonding with Mn to form non-metallic inclusions of MnS. An amount exceeding 0.0300% may be added to achieve the effect.

Ni: 0 to 1.00%

Ni deteriorates a machinability since it increases a ductility of a matrix. Thus, a Ni content is preferably not more than 1.00%, more preferably not more than 0.50%, further more preferably not more than 0.30%.

On the other hand, Ni is an element suppressing generation of a ferrite phase in a tool structure. Moreover, Ni is effective in imparting excellent hardenability to the cold work tool material, and thus enabling formation of a structure mainly composed of martensite phase to prevent deterioration of toughness even when a cooling rate in quenching is slow. Furthermore, since Ni also improves intrinsic toughness of a matrix, it may be added according to necessity in the present invention. In a case of adding Ni, not less than 0.10% is preferably added.

Nb: 0 to 1.50%

Since Nb causes deterioration of a machinability, a Nb content is preferably not more than 1.50%. On the other hand, Nb has an effect of forming carbides to strengthen a matrix and improve a wear resistance. Moreover, Nb increases a resistance to softening in tempering. Nb also has an effect of suppressing coarsening of grains and thereby contributing to improvement of a toughness similarly to vanadium. Thus, Nb may be added according to a necessity. In a case of adding Nb, not less than 0.10% is preferably added.

Cu, Al, Ca, Mg, O (oxygen) and N (nitrogen) in the composition of the cold work tool material of the present invention may possibly remain in the steel as inevitable impurities for example. In the present invention, it is preferable to limit amounts of the elements as low as possible. On the other hand, a small amount of the elements may be added to obtain additional functions or effects, such as control of a form of inclusions, or improvement of other mechanical properties or productivity. In the case, following ranges are permissible: Cu≤0.25%; Al≤0.25%; Ca≤0.0100%; Mg≤0.0100%; O≤0.0100%; and N≤0.0500%. These are preferable upper limits of the elements according to the present invention. With respect to nitrogen, more preferable upper limit is 0.0300%.

(iii) The cold work tool material of the present invention is such that "when viewing the annealed structure in a cross section parallel to a direction extended by the hot working and perpendicular to a transverse direction, carbides having a circle equivalent diameter of not smaller than 5.0 μm has a standard deviation of a carbide orientation degree Oc being not less than 6.0, wherein the carbide orientation degree Oc is defined by following equation (1):

$$Oc=D*\theta \quad (1),$$

where D represents a circle equivalent diameter, by μm, of a carbide, and θ represents an angle, by radian, between the extended direction and a major axis of an approximate ellipse of the carbide.

The cold work tool material of the present invention having the composition of "high carbon and chromium" contents includes more carbides in an annealed structure compared with that of Patent Literatures 1 and 2. It has been considered to be effective to repeat hot workings of a raw material and so on (to increase a hot working ratio) to form "finely dispersed" carbides, in order to reduce a dimensional change through heat treatment, which occurs in such a material including much carbides. However, the raw material including increased carbides has less workability in the hot working. Accordingly, it has not been easy to make the carbides fine in the annealed structure of the cold work tool material having the composition of "high carbon and chromium" contents.

According to the present invention, the dimensional expansion in a longitudinal direction can be reduced by controlling the "orientation degree" of the carbides in the longitudinal direction of the material, without depending on the method of "finely dispersing" the carbides. The "orientation degree" of the carbides in the present invention will be described below.

Figure 8:
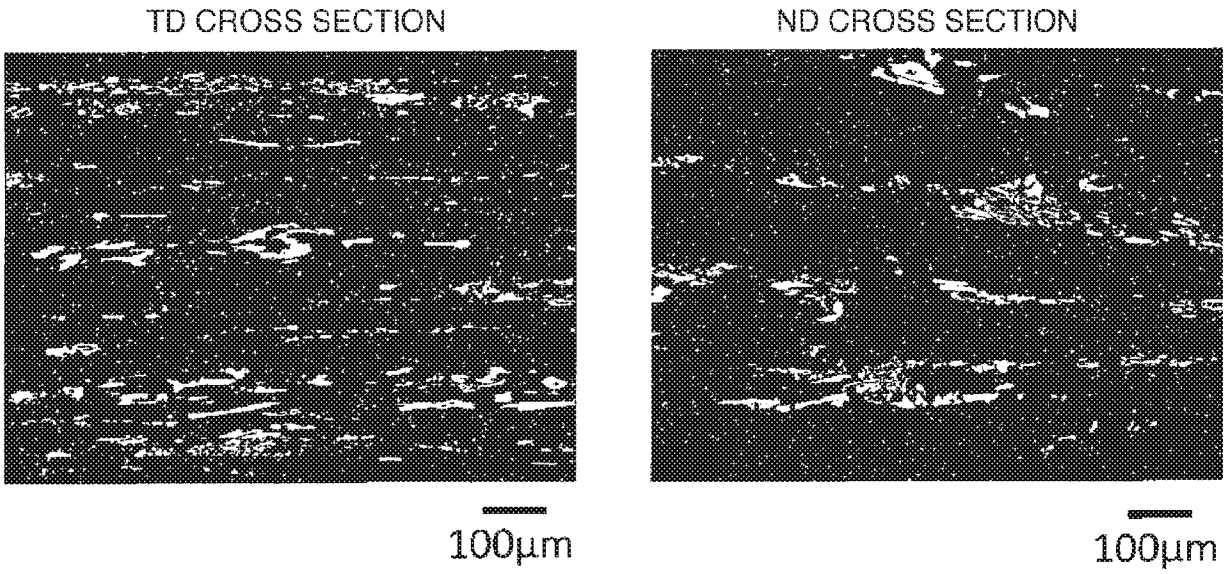
FIG. 8 is a view of an image binarizing an optical microscope photograph of a cross-sectional structure of a cold work tool material of a comparative example to show an example of carbides distributed in the cross-sectional structure.

Typically, a cold work tool material is manufactured from a raw material, as a starting material in a form of an ingot or a bloom which is produced from the ingot. The starting material is subjected to various hot workings and heat treatments to form a predetermined steel material, and then the steel material is subjected to an annealing process to produce a final material, such as in a form of a block. The ingot is typically produced by casting a molten steel having a predetermined composition. Therefore, the cast structure of the ingot includes a portion where precipitated carbides gather in a network, that is caused by a differential solidification start (i.e. due to growth of dendrite) and so on. Each carbide forming the network has a plate shape (or so-called lamellar shape). When the ingot is hot worked, the network is extended in a direction extended by the hot working (i.e. in a longitudinal direction of the material), and is compressed in a direction in which a load is applied (i.e. in a thickness direction of the material). Thus, each precipitated carbide is broken and dispersed during the hot working, and is oriented along the extended direction. As a result, a distribution of the carbides in a structure annealed after the hot working forms stacked bands of carbides which are individually broken and directed in the extended direction and gather linearly, i.e. forms "generally banded structure" (refer to FIG. 8 for example). In FIG. 8, "white dispersed substances" in a dark matrix are carbides.

Each carbide distributing in the generally banded structure functions mainly as "non-soluted carbide", and is not solid-soluted in a matrix through quenching. It remains in a quenched and tempered structure to contribute to improvement of a wear resistance of the tool. However, each carbide in the generally banded structure is extended in the longitudinal direction of the material, and is oriented in this direction. When the orientation degree is extreme (that is, the major axes of the carbides are aligned to the longitudinal direction of the material), an increased dimensional change of expansion in the longitudinal direction occurs in quenching.

The principle of the phenomena is as follows. First, a matrix of the cold work tool material expands itself by martensitic transformation by quenching. When non-soluted carbides are dispersed in the matrix, the carbides function as "resistance" to the expansion of the matrix, and suppress the expansion. However, when the non-soluted carbides are oriented in the longitudinal direction of the material, interfaces between the carbides and the matrix align in the longitudinal direction of the material, whereas a density of the interfaces crossing the longitudinal direction (that is, the interface preventing the matrix from expanding in the longitudinal direction) reduces. Thus, "resistance" to expansion of the matrix is reduced, and the expansion of the matrix in the longitudinal direction can not be suppressed.

Accordingly, the density of the interfaces between the non-soluted carbides and the matrix, that cross the longitudinal direction, can be increased by making the orientation of the carbides irregularly from the extended direction. As a result, the "resistance" to expansion of the matrix in the longitudinal direction increases, and the dimensional change of expansion in the longitudinal direction of the material can be reduced. In the present invention, the orientation degree of the non-soluted carbides is quantified, and it was found that the value of the quantified orientation degree has correlation with an amount of the dimensional expansion in the longitudinal direction of the material. It was also found that optimal control of the quantified orientation degree is effective in reducing the dimensional expansion in the longitudinal direction.

The present inventors first investigated what sizes of the non-soluted carbides affect the dimensional change of the material through the heat treatment. As a result, it was found that "carbides having a circle equivalent diameter of not less than 5.0 μm" in an annealed structure of a cross section parallel to the extended direction of the material is regarded as the carbides affecting the dimensional change. Typically, "carbides having a circle equivalent diameter of not less than 5.0 μm" are included in the annealed structure in an amount of about 1.0 to about 30.0 area %.

Then, an orientation degree Oc of each of "carbides having a circle equivalent diameter of not less than 5.0 μm" (hereinafter referred to as "carbide orientation degree") is defined by a product of multiplying a "circle equivalent diameter D (μm)" of the carbide and an "angle θ (rad)" between a major axis of an approximate ellipse of the carbide and the direction extended by the hot working. This equation means that the non-soluted carbide has a resistance to expansion in the longitudinal direction of the material, that is determined synergistically by the size of the carbide (corresponding to the "circle equivalent diameter D") and an inclination of the major axis of the carbide (corresponding to the "angle θ").

Figure 10:
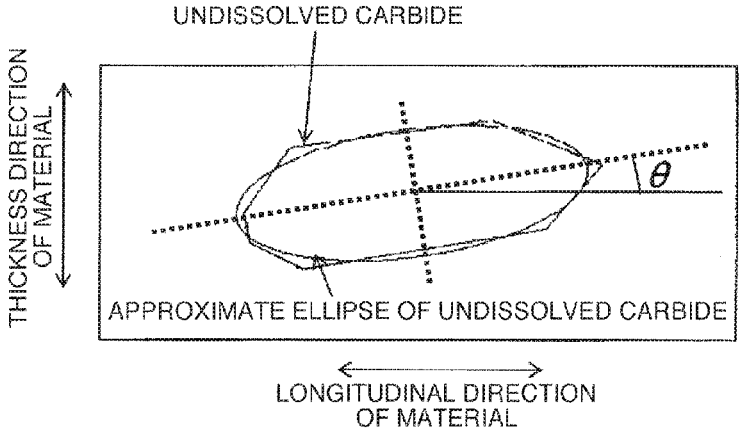
FIG. 10 is a view explaining "an approximate ellipse" of a carbide having a circle equivalent diameter of not less than 5 μm in the present invention and "an angle between a major axis and an extended direction" in the approximate ellipse.

The "circle equivalent diameter D" of a carbide is defined for a carbide having a certain cross-sectional area, as a diameter of a circle having the same area as that of the carbide. The "angle θ" is defined, for a carbide having a certain shape. When the shape is approximated as an ellipse, the "angle θ" is defined as an angle between a major axis of the ellipse of the carbide and the direction extended by the hot working (see FIG. 10). Here, the "angle θ" may be obtained as follows: determining a tentative "angle θ" with respect to a tentative direction; determining a direction along which most of the carbides are oriented and deem the direction to be the extended direction (that is, "0" degree); and determine an inclination ("angle θ") of a major axis of the carbide. In the case, the "angle θ" can be obtained to one place of decimal. Thus, a cross section parallel to the extended direction can observed and evaluated, by observing an annealed structure of the cold work tool material to confirm the extended direction (that is, angle "0" degree) from the observation of the non-soluted carbide. In this cross section parallel to the extended direction, the non-soluted carbide is observed as extend long in a lateral direction and form "generally banded structure". Also, the "approximate ellipse" is an ellipse most fit to a shape of a carbide. It is obtained by drawing an ellipse having a same center of figure as the shape of a carbide and having a same second moment of area, and then downsizing it to have an area same as that of the carbide (see FIG. 10). Such process can be conducted by a known image analysis software or the like.

An example of a measuring method of the "circle equivalent diameter D" and the "angle θ" of the carbide will be described.

Figure 11:
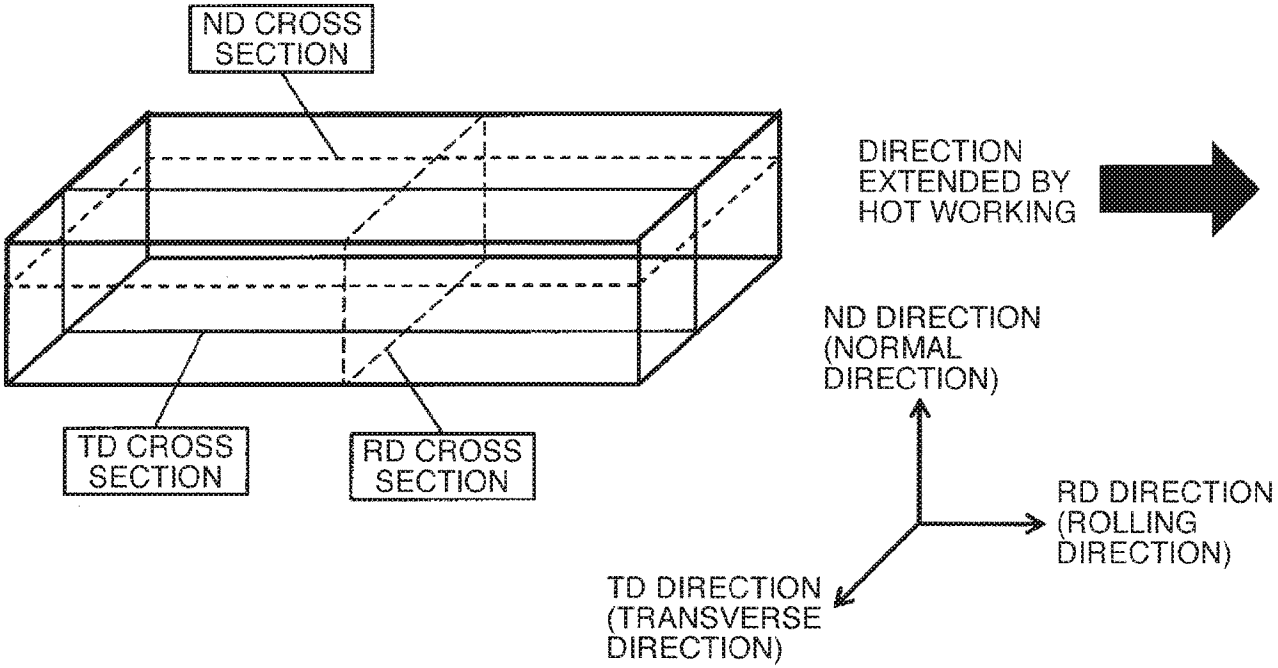
FIG. 11 is a view explaining "a transverse direction" and "a normal direction" of the cold work tool material extended by hot working.

First, a cross-sectional structure of the cold work tool material is observed with use of an optical microscope with a magnification of e.g. 200 times. The cross section to be observed is a portion to be formed into the cold work tool. Also, the observed cross section is a cross section (so-called "TD cross section") that is perpendicular to a TD direction (Transverse Direction) among cross sections parallel to the direction extended by hot working (that is, a longitudinal direction of the material). The TD cross section is a section compressed in a direction of an applied load in the hot working (that is, the thickness direction of the material), and extended in the direction extended by hot working (that is, a longitudinal direction of the material). The cross section is shown in FIG. 11 (where the cold work tool material is illustrated as a substantially rectangular parallelepiped). Therefore, carbides observed in a structure of the TD cross section are most oriented to the extended direction among the cross sections parallel to the extended direction, and can be regarded to have smallest "standard deviation of a carbide orientation degree Oc". Accordingly, it is effective to obtain the "standard deviation of a carbide orientation degree Oc" in the TD cross section and evaluate it in order to securely achieve the "dimensional expansion reducing effect" of the present invention.

A cut surface in the TD cross section having an area of e.g. 15 mm*15 mm is polished in a mirror state using a diamond slurry. Preferably, the polished mirror surface in the cross section is corroded with use of various methods before observation so that a boundary between the non-soluted carbide and the matrix becomes remarkable.

Next, an optical microscope photograph obtained by the observation is subjected to image processing, and a binarizing process is conducted with the boundary (for example, the boundary of the colored part and the uncolored part by the etching) taken as a threshold. Thus, a binarized image showing the carbides distributed in the matrix of the cross-sectional structure is obtained. FIG. 1 shows binarized images (TD cross section and ND cross section) (field of view area: 0.58 $mm^2$) of the cold work tool material of the present invention ("cold work tool material 1" of the present invention in the example). In FIG. 1, carbides are shown by a white distribution. Such binarizing process can be conducted by known image analysis software or the like.

The image of FIG. 1 may further image processed to extract carbides having a circle equivalent diameter of not less than 5.0 μm, and to measure the circle equivalent diameter D (μm) and angle θ (rad) of each carbide. The method for determining the "direction extended by hot working" that is a base of the angle θ is as described above. The carbide orientation degree Oc and the standard deviation thereof can be obtained from these values. The circle equivalent diameter D and the angle θ of the carbide also can be obtained by a known image analysis software or the like.

The orientation degree of "carbides having a circle equivalent diameter of not less than 5.0 μm" with respect to the longitudinal direction can be quantitatively evaluated by "standard deviation" of the carbide orientation degree Oc. When the value of standard deviation is optimally controlled, the dimensional change of expansion in the longitudinal direction of the material can be reduced.

When the standard deviation is small, orientation degrees of "carbides having a circle equivalent diameter of not less than 5.0 μm" are almost aligned to one direction of the longitudinal direction of the material. In this state, a density of interfaces between the carbide and the matrix reduces, which cross the longitudinal direction, and thus a resistance to the expansion in the longitudinal direction reduces. Thus, the expansion in the longitudinal direction of the material increases.

On the other hand, when the standard deviation becomes great, the orientation degrees of "carbides having a circle equivalent diameter of not less than 5.0 μm" become irregularly with respect to the longitudinal direction, and the density of the interfaces crossing the longitudinal direction increases. As a result, the resistance to the expansion in the longitudinal direction increases, and the expansion in the longitudinal direction is suppressed.

In the present invention, the value of the standard deviation is determined to be "not less than 6.0" in an annealed structure of the TD cross section of the cold work tool material. Thus, the resistance sufficiently increases, and the dimensional expansion reducing effect of the present invention can be achieved. The value of the standard deviation is preferably "not less than 6.5", more preferably "not less than 7.0". However, if the value of the standard deviation is too large, it is considered that a cast structure has not removed, and it is afraid that a toughness is deteriorated when it is worked in a cold work tool. Therefore, the standard deviation is to be made preferably "not more than 10.0", more preferably "not more than 9.0".

Figure 9:
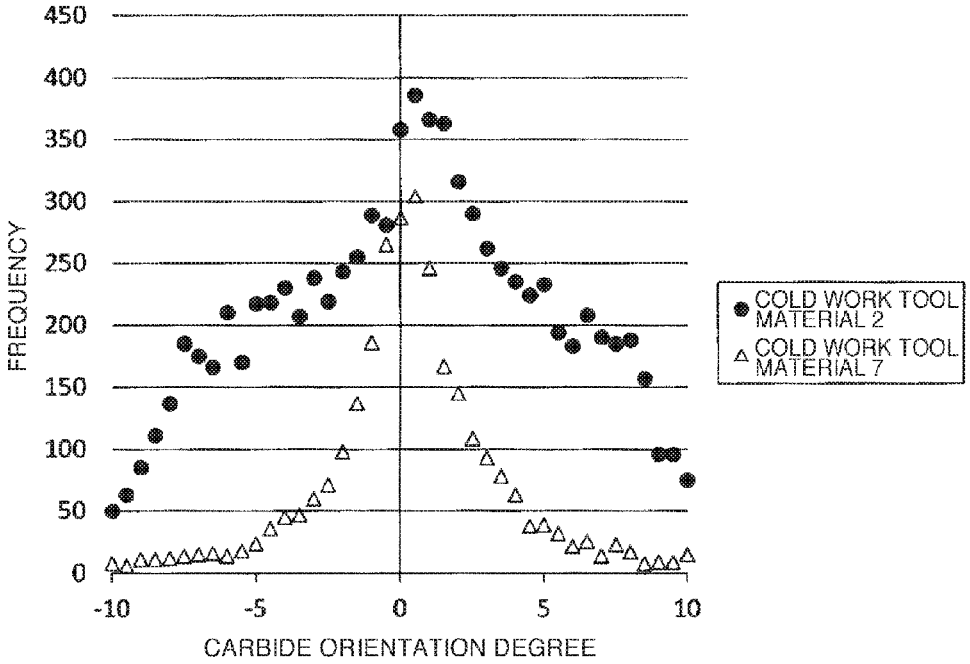
FIG. 9 is a graph showing an example of distributions of the carbide orientation degree Oc of carbides distributed in the cross-sectional structure of the cold work tool material of an example according to the present invention and a comparative example.

FIG. 9 is a graph showing distributions of the "carbide orientation degree Oc" of carbides having a circle equivalent diameter of not less than 5.0 μm as observed in the annealed structure of the TD cross section, for examples ("cold work tool material 2" of the present invention and "cold work tool material 7" of the comparative example). The horizontal axis of the graph represents the carbide orientation degree Oc of each carbide, and the vertical axis represents a frequency thereof. The value of the carbide orientation degree Oc takes a positive or negative value according to the inclination direction of the major axis of the approximate ellipse of the carbide relative to the direction extended by hot working. The frequency of the carbide orientation degree Oc shows a distribution of a convex shape having its crest in the vicinity of a point where the value of Oc becomes "zero". In the present invention, the standard deviation of the carbide orientation degree Oc showing such distribution of a convex shape is made not less than 6.0, and thereby excellent dimensional expansion reducing effect is achieved. The carbide orientation degree Oc and the standard deviation also can be obtained by a known image analysis software or the like. A series of operations for obtaining the standard deviation of the carbide orientation degree Oc of the carbide having a circle equivalent diameter of not less than 5.0 μm according to the present invention can be conducted by a known image analysis software or the like.

In FIG. 9, the frequency is taken as the total of the carbides belonging to a section of a width of 0.5 (μm*rad) in the carbide orientation degree Oc. (The frequency in relation to carbide orientation degree Oc in a range of "not less than −0.5 to less than 0" is plotted at the position of "0" of Oc. The angle θ of each carbide, which is the basic data in obtaining the carbide orientation degree Oc, are obtained to the place of 0.001°. The place of the angle θ can be set appropriately.

In the case of the cold work tool material of the present invention, the optical microscope photographs rendered to the image processing described above are sufficient to observe 10 fields of view with 200 times of the magnification for confirming the "dimensional expansion reducing effect". The area of the observation field of view may be made 0.58 $mm^2$ per one field of view.

In the requirement of above (iii), the words "annealed structure" can be substituted to "martensitic structure" in the cold work tool of the present invention.

(iv) Preferably, the cold work tool material of the present invention is such that "the carbides having a circle equivalent diameter of not less than 5.0 μm has the standard deviation of the carbide orientation degree Oc determined by the equation (1) being not less than 10.0, in viewing the annealed structure of the cold work tool material in a cross section parallel to the extended direction by the hot working and perpendicular to a normal direction It is also effective in improving "dimensional expansion reducing effect" of the present invention to further control the "standard deviation of carbide orientation degree Oc" in an ND cross section of the cold work tool material. The ND cross section means a cross section perpendicular to the ND direction (Normal Direction) in the annealed structure among cross sections parallel to the extended direction of the material. That is, the ND cross section is parallel to a plane on which a load is applied in the hot working (that is, the surface with which a load applying tool contacts). The cross section is shown in FIG. 11 (the material is illustrated to be a substantially rectangular parallelepiped).

The ND cross section is also a section extended by hot working (or in a longitudinal direction of the material) as the TD cross section. However, in the ND cross section, a random orientation that the precipitated carbides had in a cast structure can be maintained by suppressing compression in a width direction (TD direction) of the material during the hot working (for example, by not restricting by a load applying tool). Thus, the "standard deviation of carbide orientation degree Oc" can be easily controlled to be large. Therefore, it is effective in further improving the "dimensional expansion reducing effect t" of the present invention by controlling the "standard deviation of carbide orientation degree Oc" of the carbides having a circle equivalent diameter of not less than 5.0 μm to "6.0 or more" in the TD cross section and further controlling it to a particularly larger value in the ND cross section. Preferably, the standard deviation of the carbide orientation degree Oc obtained by the equation (1) of the carbides having a circle equivalent diameter of not less than 5.0 μm in the annealed structure of the ND cross section is made "not less than 10.0", more preferably "not less than 12.0".

However, if the value is too large, the cast structure may have not been removed, and a toughness may be deteriorated when the material is worked in a cold work tool. Therefore, the standard deviation in the ND cross section is to be made preferably "not more than 20.0", more preferably "not more than 16.0".

In the requirement of the above (iv), the words "annealed structure" can be substituted to words "martensitic structure" in the cold work tool of the present invention.

As cross sections of the cold work tool material, FIG. 11 illustrates an RD cross section as well as the above TD and ND cross sections. The RD cross section is perpendicular to an RD direction (Rolling Direction) of the material. The RD cross section is not substantially elongated in the extended direction by the hot working, differently from the TD and ND cross sections. Therefore, even supposing that the RD cross section of the annealed structure includes the "carbides having a circle equivalent diameter of not less than 5.0 μm" by about 1.0 to about 30.0 area %, an average value of the circle equivalent diameter of the carbides is smaller than that of the TD and ND cross sections. As an example, when the average value of the circle equivalent diameter of the "carbides having a circle equivalent diameter of not less than 5.0 μm" in the TD or the ND cross section is not less than 6.0 μm, particularly "8.0 μm" or "10.0 μm", the value in the RD cross section is "less than 8.0 μm" or "less than 10.0 μm" respectively.

Therefore, the requirement "the annealed structure in a cross section parallel to a direction extended by the hot working and perpendicular to a transverse direction" can be also expressed as "the annealed structure of the cold work tool material in an cross section among three directional cross sections each parallel to one of outer surfaces of a substantially rectangular parallelepiped, the above cross section is selected by first, selecting two cross sections by excluding a cross section where an observed average value of a circle equivalent diameter of carbides having a circle equivalent diameter of not less than 5.0 μm is smallest, second, select one cross section where the standard deviation of the carbide orientation degree Oc obtained by above equation (1) of the carbides having a circle equivalent diameter of not less than 5.0 μm is smaller".

Also, in the cold work tool of the present invention, the words "annealed structure" can be substituted to "martensitic structure".

Furthermore, the requirement "the annealed structure of the cold work tool material in a cross section parallel to the direction extended by the hot working and perpendicular to a normal direction" can be also expressed as "the annealed structure of the cold work tool material in an cross section among three directional cross sections each parallel to one of outer surfaces of a substantially rectangular parallelepiped, the above cross section is selected by:

first, selecting two cross sections by excluding a cross section where an observed average value of a circle equivalent diameter of carbides having a circle equivalent diameter of not less than 5.0 μm is smallest, and then, select one cross section where the standard deviation of the carbide orientation degree Oc obtained by above equation (1) of the carbides having a circle equivalent diameter of not less than 5.0 μm is greater."

Also, in the cold work tool of the present invention, the words "annealed structure" can be substituted to "martensitic structure".

The annealed structure of the cold work tool material of the present invention can be achieved by properly controlling conditions of the hot working of an ingot or a bloom as a starting material. It is important to minimize a working ratio in the hot working, in order to obtain the annealed structure in which the orientation of the non-soluted carbides is irregular, or which has the standard deviation of the carbide orientation degree Oc being "not less than 6.0" in the TD cross section. In order to control the standard deviation of the carbide orientation degree Oc to be not less than 6.0, the hot working of the ingot (or the bloom) is conducted as solid forging with "forging ratio" of "not more than 8.0" where the forging ratio is expressed by A/a where "A" is a transverse cross sectional area of the ingot (or the bloom) before the hot working and "a" is a transverse cross sectional area reduced after the hot working. The solid forging means hot working of a solid body (that is, the above ingot or bloom) by forging to reduce a cross-sectional area and elongate a length. The forging ratio is more preferably "not more than 7.0", further more preferably "not more than 6.0". If the forging ratio is too large, the precipitated carbides in the ingot are aligned in the TD cross section along the direction extended by the hot working, and the standard deviation of the carbide orientation degree Oc is hardly increased.

However, when the forging ratio is too small, a cast structure is not broken, and toughness may be deteriorated in a cold work tool. Therefore, the forging ratio is preferably "not less than 2.0", more preferably "not less than 3.0".

Also, it is effective to suppress compression in a width direction (TD direction) of the material in the hot working, in order to obtain the annealed structure in which the orientation of the non-soluted carbides is irregular, or which has the standard deviation of the carbide orientation degree Oc being "not less than 10.0" in the ND cross section. Specifically, it is preferable, for example, not to constrain, by a load applying tool or the like, both ends in the width direction of the material (ingot) during the hot working. In this regard, the both ends may be constrained in order to adjust the width shape and dimension of the material after the hot working. However, if the both ends are constrained to a degree at which a the width of the material after the hot working becomes smaller than that of the ingot before the hot working, the ND cross section of the material after the hot working includes the carbides which precipitated in the ingot are liable to be aligned in the direction extended by the hot working, and the standard deviation of the carbide orientation degree Oc is hardly increased.

As a measure for the hot working without constraining both ends in the width direction of the material (ingot) during the hot working, or without constraining excessively, even if constrain may be conducted, a blooming machine such as a press, hammer, mill by free forging may be used for example.

It has been considered mainly that reduction of large carbides was effective to reduce the dimensional change in the heat treatment of the cold work tool material of "high carbon and chromium". Thus, a method of increasing the hot working ratio and miniaturizing the carbides has been taken. However, the raw material including too carbides is inferior in hot workability. Therefore, it was not easy to miniaturize the carbides in an annealed structure of the cold work tool material of "high carbon and chromium". In the circumstances, the present invention makes large carbides orientated irregularly, and it is not necessary to manage to miniaturize the large carbides. Therefore, the cold work tool material with reduced heat treatment dimensional change can be provided efficiently.

It is also effective to properly control solidification in producing the ingot (or bloom) to be hot worked, in addition to the hot working ratio and the constraint of the material, in the production of the cold work tool material of the present invention. For example, it is important to adjust a "temperature of molten steel" immediately before poured into a mold. When the temperature of the molten steel is controlled lower, for example up to about 100° C. higher than a melting point of the material, it is possible to reduce a local concentration of the molten steel caused by difference in solidification starting time between positions in the mold, and to suppress coarsening of the precipitated carbides caused by growth of dendrite. Furthermore, it is effective to cool the molten steel poured into a mold, for example, so as to pass a solid-liquid coexistence region in a short time period, for example a cooling time period within 60 minutes. When coarsening of the precipitated carbides is suppressed, the carbides can be broken to a moderate size even under a condition with small working hot working ratio. As a result, the non-soluted carbides in the annealed structure can be distributed with "uniform density". When the ingot (or bloom) produced under these conditions is hot worked with the above forging ratio and the constraint, the material of the present invention can have great standard deviation of the carbide orientation degree Oc.

For suppressing the dimensional change of expansion in a longitudinal direction of the material in the present invention, it is effective that a distribution of the non-soluted carbides is dense particularly in a "thickness direction" of the material, in other words, an interval between layers of the carbides in a generally banded structure is "small" in FIG. 1 or the like. Thus, a degree of the dimensional expansion in the longitudinal direction of the material can be made uniform over a thickness direction.

(v) A method of the present invention for manufacturing a cold work tool includes "a step of quenching and tempering the cold work tool material of the present invention".

The cold work tool material of the present invention is adjusted to have a martensitic structure with a predetermined hardness by quenching and tempering, and this is produced into a cold work tool product. The material is finished into a shape of the tool by various machining and or like, such as cutting and boring. Preferably, the machining is conducted before quenched and tempered while the material has a low hardness (or in an annealed state). Thus, the "dimensional expansion reducing effect" of the present invention is effectively obtained with respect to the heat treatment dimensional change during quenching and tempering. In the case, finish machining work may be conducted after the quenching and tempering.

A temperature for the quenching and tempering is different according to a composition of a raw material, a target hardness, or the like. Preferably, the quenching temperature is about 950° C. to about 1,100° C. and the tempering temperature is about 150° C. to about 600° C. For SKD10 and SKD11 for example, which are representative steel types of the cold work tool steel, the quenching temperature is about 1,000° C. to about 1,050° C., and the tempering temperature is about 180° C. to about 540° C. A hardness obtained by quenching and tempering is preferably not smaller than 58 HRC, more preferably not smaller than 60 HRC. While an upper limit of the hardness is not particularly limited, not greater than 66 HRC is realistic.

EXAMPLES

Molten steels (having a melting point of about 1,400° C.) adjusted to have compositions of Table 1 were cast to produce raw materials A, B, C and D. The compositions correspond to those of the cold work tool steel SKD10 which is a standard steel type pursuant to JIS-G-4404. Cu, Al, Ca, Mg, O and N were not added to all raw materials, (however, Al was added as a deoxidizer in the melting step), and satisfied Cu≤0.25%, Al≤0.25%, Ca≤0.0100%, Mg≤0.0100%, O≤0.0100%, and N≤0.0500%.

Before pouring the molten steel into the mold, a temperature of the molten steel was adjusted at 1,500° C. Also, a cooling time period passing the solid-liquid coexistence region after the pouring of the molten steel was controlled by changing sizes of the mold. Thus, the time period is as follows: raw materials A, B: 45 minutes, raw material C: 106 minutes, and raw material D: 168 minutes.

TABLE 1 mass %

| Raw material | C | Si | Mn | P | S | Cr | Mo | V | Fe[x] |
|---|---|---|---|---|---|---|---|---|---|
| A | 1.48 | 0.53 | 0.42 | 0.022 | 0.0002 | 11.9 | 0.76 | 0.74 | Bal. |
| B | 1.48 | 0.48 | 0.42 | 0.022 | 0.0004 | 12.0 | 0.73 | 0.79 | Bal. |
| C | 1.52 | 0.31 | 0.39 | 0.020 | 0.0007 | 11.7 | 0.74 | 0.81 | Bal. |
| D | 1.48 | 0.42 | 0.32 | 0.025 | 0.0008 | 11.4 | 0.87 | 0.69 | Bal. |

[x]including impurities

These raw materials were heated at 1,160° C., and hot worked i.e. free forged by pressing. They were then naturally cooled to produce the steels with sizes shown in Table 2 (a length was 1,000 mm for all). Forging ratios of solid forging in the hot working are also shown in Table 2. Next, the steels were subjected to annealing at 860° C. to produce cold work tool materials 1 to 8 (having a hardness of 190 HBW). An annealed structure of the cross section of each cold work tool material 1 to 8 was observed and a distribution of carbides having a circle equivalent diameter of not less than 5.0 μm was observed by a procedure described below.

For each cold work tool material, a cross-sectional surface having an area of 15 mm*15 mm was taken from a TD plane and a ND plane which are parallel to a direction extended by the hot working (that is, in a longitudinal direction of the material) at a position ¼ width inward from a surface and ½ thickness inward from a surface. Then, the cross-sectional surface was polished to a mirror surface with a diamond slurry. Next, the annealed structure of the polished cross-sectional surface was etched by electrolytic polishing so that a boundary between carbides and a matrix became clear. The etched cross section was observed by an optical microscope with the magnification of 200 times, and 10 fields of view were photographed with one field of view having a region of 877 μm*661 μm (0.58 $mm^2$).

The optical microscope photograph was subjected to image processing to conduct a binarizing with setting, as a threshold, a boundary between a colored part and an uncolored part by the etching which corresponds to a boundary of the carbide and the matrix. Thus, a binarized image showing the carbides distributed in the matrix of the cross-sectional structure was obtained. FIGS. 1 to 8 show each example of the binarized image of the TD and ND cross sections of the materials 1 to 8 sequentially (the carbide is shown by a white color). Further image processing was conducted to extract carbides having a circle equivalent diameter of not less than 5.0 μm, and measure a circle equivalent diameter D (μm) and an angle θ (radian) of the carbide, which is an angle between a major axis of an approximate ellipse of the carbide and a direction extended by the hot working, and "carbide orientation degree Oc" which is a product of multiplying the circle equivalent diameter D and the angle θ for each carbide in each of the TD and ND cross sections. FIG. 9 shows an example of the distributions of the carbide orientation degree Oc obtained in the TD cross section of the cold work tool materials 2 and 7. A standard deviation of the carbide orientation degree Oc in the 10 fields of view was calculated. A series of these image processing and analysis were conducted with use of an open source image processing software "ImageJ" (http://imageJ.nih.gov/ij/) supplied from the National Institutes of Health of America (NIH).

Figure 2:
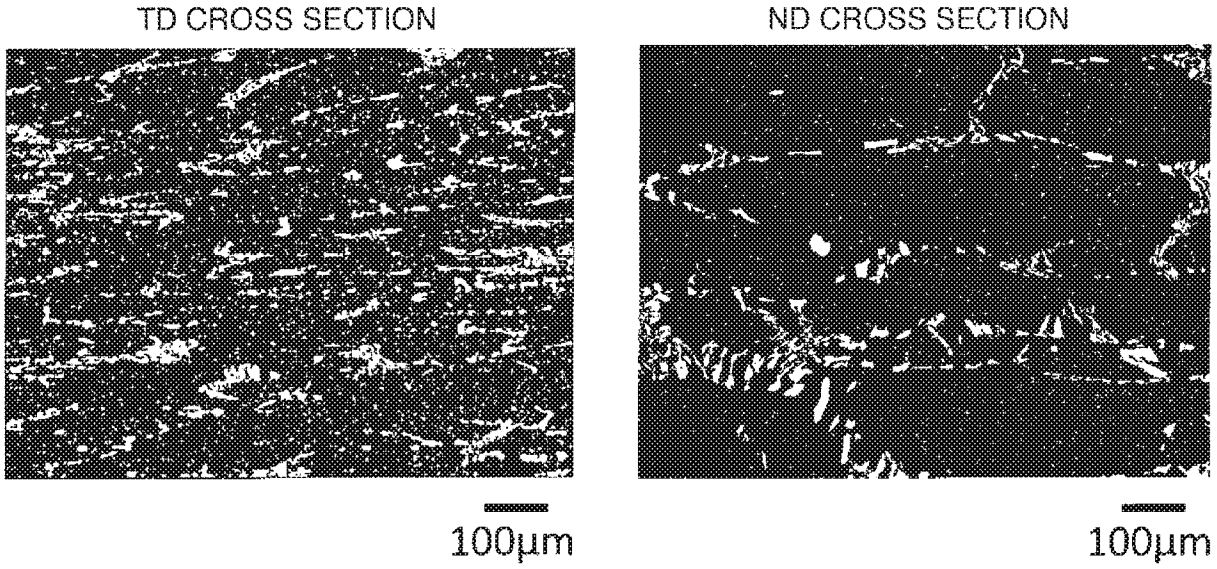
FIG. 2 is a view of an image binarizing an optical microscope photograph of a cross-sectional structure of a cold work tool material of an example according to the present invention to show an example of carbides distributed in the cross-sectional structure.

FIG. 2 shows the results. FIG. 2 shows an area ratio of the carbides having a circle equivalent diameter of not smaller than 5.0 μm and an average value of the circle equivalent diameters in each of the TD cross section and the ND cross section obtained from the image processing of the binarized image of the 10 fields of view. It was confirmed that the average value of the circle equivalent diameters were about 9.0 to about 15.0 μm in the TD cross section and the ND cross section in all materials and were larger than that in the RD cross section.

Then, a dimensional change occurring when the materials 1 to 8 were quenched was evaluated. The dimensional change was evaluated with respect to "quenching" since a large expansion in the longitudinal direction in quenching can not be compensated any more in the next tempering step.

A test piece for evaluating the dimensional change was taken from a position where the carbide orientation degree Oc of the material was measured, in such a way that the longitudinal direction of the test piece is directed to the longitudinal direction of the material. The dimension of the test piece has a length of 30 mm, a width of 25 mm and a thickness of 20 mm. Six surfaces of the test piece were polished so that opposing surfaces became parallel to each other.

Next, these test pieces were quenched from 1,030° C. to generate a martensitic structure. A longitudinal distance between surfaces of the test piece was measured before and after the quenching, and thus the dimensional change in the longitudinal direction was obtained. The distance was measured at 3 points in a vicinity of a center of the surface, and the measured values were averaged. The dimensional change ratio was determined by a change ratio of the distance B after the quenching to the distance A before the quenching:

$$[(\text{distance } B - \text{distance } A)/\text{distance } A]*100(\%)$$

(the change ratio becomes positive in a case of expansion).

At this time, a distance between surfaces in a width direction of the test piece was also measured before and after the quenching, and the heat dimensional change in the width direction was also obtained. This procedure is same as that in the longitudinal direction. Also, the dimensional change ratio in the longitudinal direction when the dimensional change ratio in the width direction is taken as a reference "zero" was also obtained:

[(dimensional change ratio in longitudinal direction)−(dimensional change ratio in width direction)]

Figure 3:
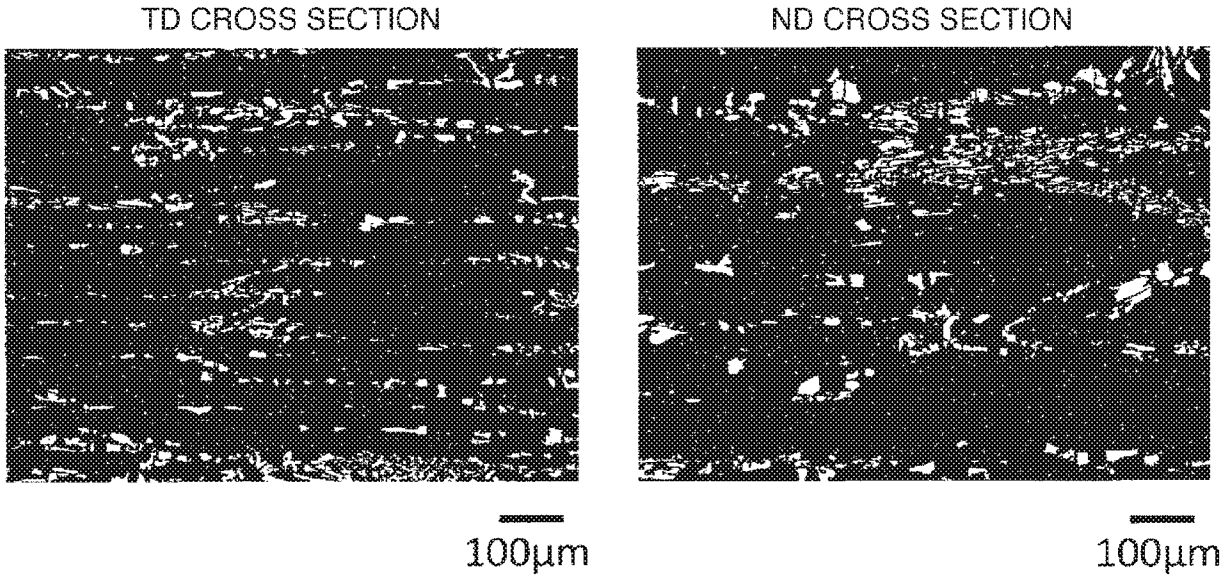
FIG. 3 is a view of an image binarizing an optical microscope photograph of a cross-sectional structure of a cold work tool material of an example according to the present invention to show an example of carbides distributed in the cross-sectional structure.
Figure 4:
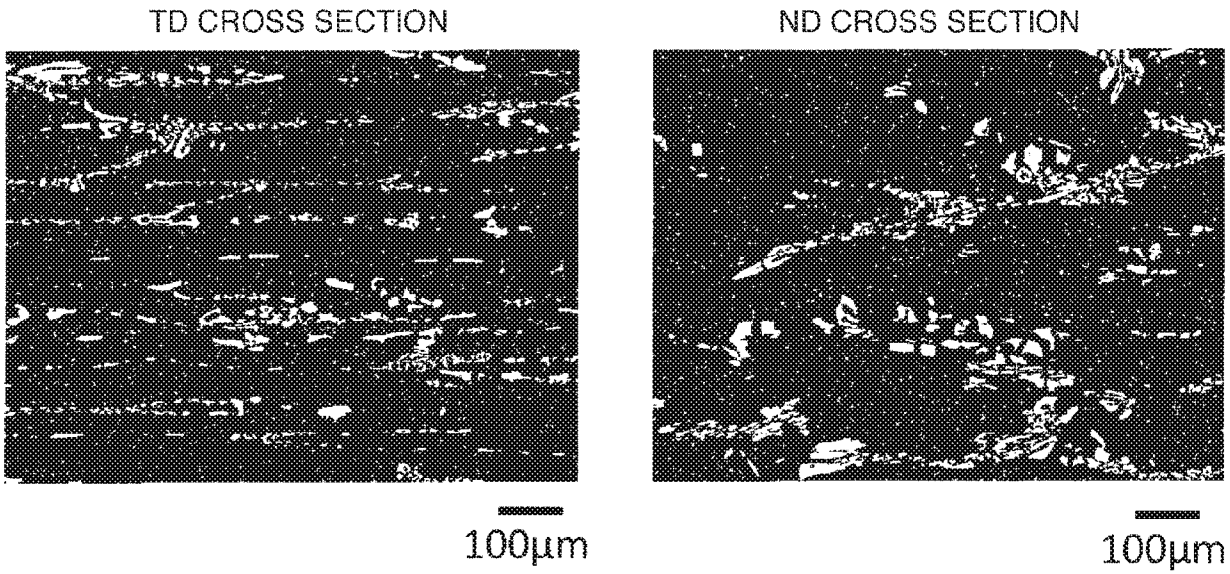
FIG. 4 is a view of an image binarizing an optical microscope photograph of a cross-sectional structure of a cold work tool material of an example according to the present invention to show an example of carbides distributed in the cross-sectional structure.
Figure 5:
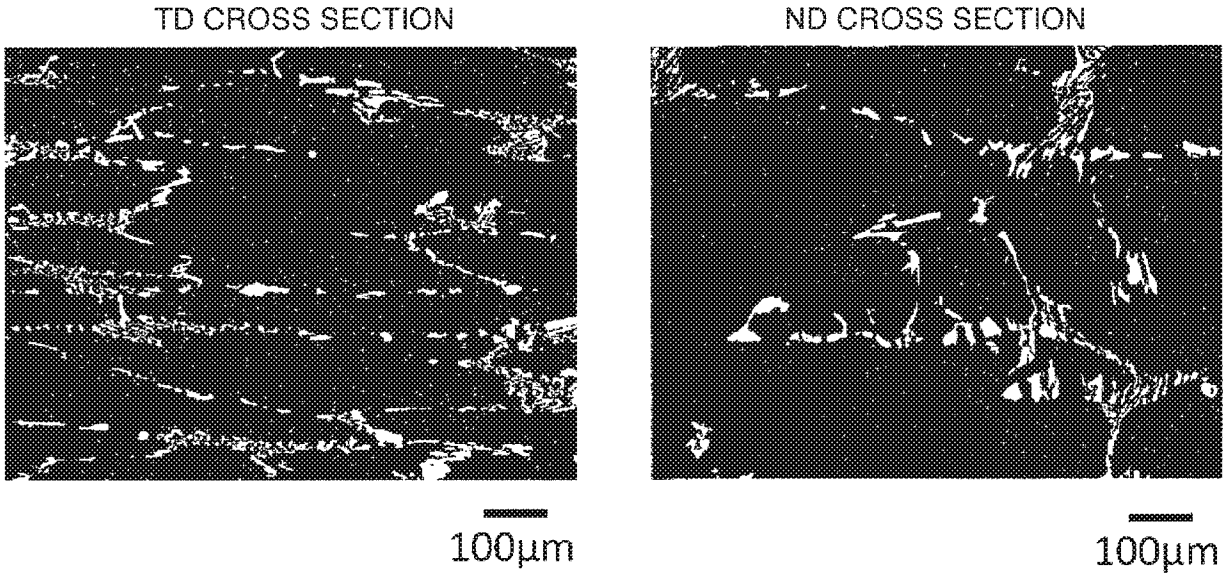
FIG. 5 is a view of an image binarizing an optical microscope photograph of a cross-sectional structure of a cold work tool material of an example according to the present invention to show an example of carbides distributed in the cross-sectional structure.
Figure 6:
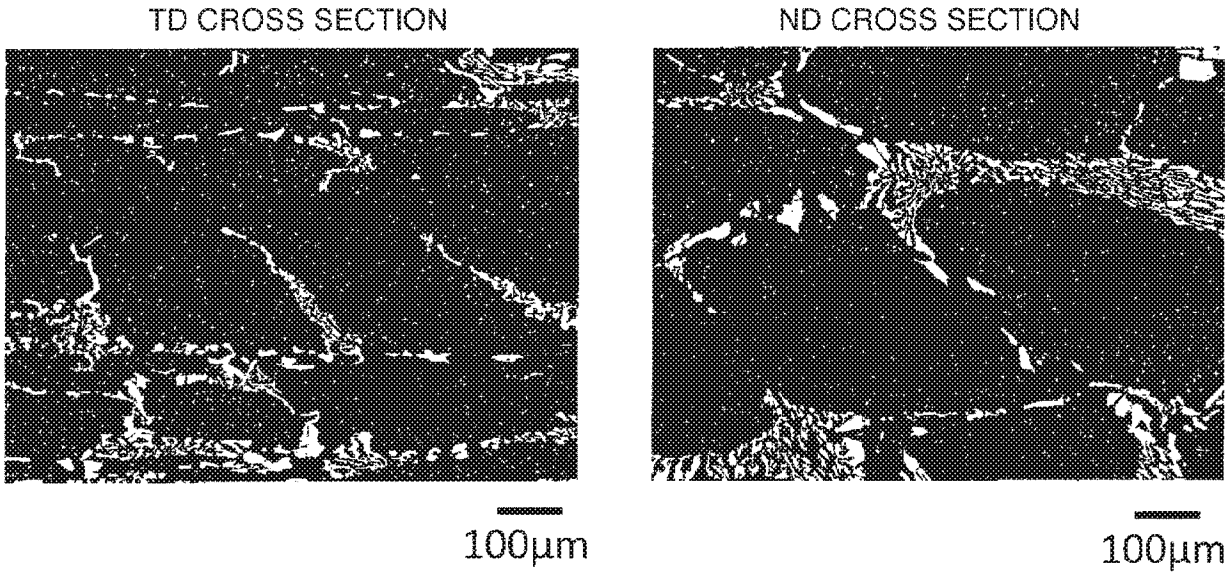
FIG. 6 is a view of an image binarizing an optical microscope photograph of a cross-sectional structure of a cold work tool material of an example according to the present invention to show an example of carbides distributed in the cross-sectional structure.
Figure 7:
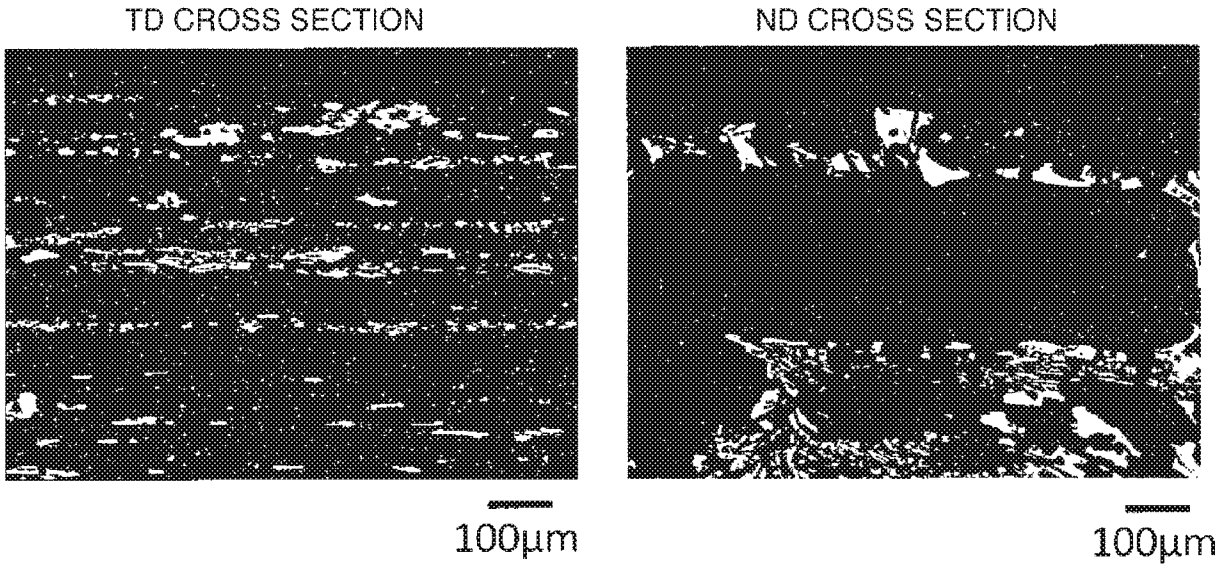
FIG. 7 is a view of an image binarizing an optical microscope photograph of a cross-sectional structure of a cold work tool material of a comparative example to show an example of carbides distributed in the cross-sectional structure.

(The value is shown in the column of "dimensional change ratio (%) in relation to width direction" of FIG. 3). Thus, "anisotropy" of the dimensional change relative to the width direction of the material can be also evaluated, in addition to the dimensional change "itself" in the longitudinal direction of the material that exhibits the greatest expansion ratio. The dimensional change ratios through the heat treatment in the cold work tool materials 1 to 8 are shown in Table 3.

TABLE 2

| | | | | Carbides having circle equivalent diameter of not less than 5.0 μm | | | | | | |
|---|---|---|---|---|---|---|---|---|---|---|
| | | Dimension | | Standard deviation of carbide orientation degree Oc | | Area ratio (%) | | Average of circle equivalent diameter (μm) | | |
| Tool material | Raw material | (thickness/mm * width/mm) | Forging ratio | TD cross section | ND cross section | TD cross section | ND cross section | TD cross section | ND cross section | Remarks |
| 1 | A | 75 × 630 | 5.1 | 7.1 | 13.9 | 9.9 | 7.6 | 12.1 | 14.6 | Example |
| 2 | A | 80 × 110 | 3.1 | 7.1 | 10.0 | 9.1 | 7.1 | 9.3 | 11.5 | according |
| 3 | B | 38 × 535 | 7.1 | 6.1 | 9.3 | 8.5 | 7.3 | 10.4 | 12.6 | to the |
| 4 | B | 43 × 535 | 6.4 | 6.0 | 10.5 | 7.6 | 8.3 | 10.7 | 12.0 | present |
| 5 | B | 105 × 535 | 3.9 | 7.6 | 16.2 | 6.8 | 7.5 | 11.5 | 13.9 | invention |
| 6 | B | 125 × 535 | 3.3 | 8.7 | 13.8 | 7.9 | 8.5 | 12.3 | 12.5 | |
| 7 | C | 80 × 630 | 8.1 | 4.7 | 10.7 | 7.6 | 6.4 | 11.7 | 13.2 | Comparative |
| 8 | D | 60 × 500 | 12.0 | 3.1 | 6.3 | 6.6 | 5.5 | 10.6 | 10.1 | example |

TABLE 3

| Tool material | Standard deviation of carbide orientation degree Oc: TD cross section | Standard deviation of carbide orientation degree Oc: ND cross section | Dimensional change ratio in longitudinal direction (%) | Dimensional change ratio in longitudinal direction in relation to width direction (%) | Remarks |
|---|---|---|---|---|---|
| 1 | 7.1 | 13.9 | 0.09 | 0.04 | Example according to the present invention |
| 2 | 7.1 | 10.0 | 0.07 | 0.03 | |
| 3 | 6.1 | 9.3 | 0.07 | 0.05 | |
| 4 | 6.0 | 10.5 | 0.08 | 0.04 | |
| 5 | 7.6 | 16.2 | 0.07 | 0.02 | |
| 6 | 8.7 | 13.8 | 0.09 | 0.04 | |
| 7 | 4.7 | 10.7 | 0.12 | 0.10 | Comparative example |
| 8 | 3.1 | 6.3 | 0.17 | 0.15 | |

In the annealed structure of the material 8 corresponding to a conventional cold work tool material, carbides were aligned in the longitudinal direction of the material as shown in FIG. 8. The standard deviation of the carbide orientation degree Oc of the carbides having a circle equivalent diameter of not less than 5.0 μm was 3.1 in the TD cross section, and the dimensional change ratio in the longitudinal direction through the quenching was 0.17% of expansion. Furthermore, the dimensional change ratio in the longitudinal direction in relation to the width direction was 0.15%, and thus the expansion in the longitudinal direction relative to the width direction (that is, anisotropy of the dimensional change) was extremely large.

The material 7 (see FIG. 7) has the standard deviation of the carbide orientation degree Oc in the TD cross section was 4.7, and the dimensional change ration in the longitudinal direction through the quenching exceeded 0.10%. Also, the dimensional change ratio in the longitudinal direction in relation to the width direction was 0.10%, and anisotropy of the dimensional change was large.

On the other hand, the carbides observed in the annealed structure of the materials 1 to 6 according to the present invention were orientated irregularly in the longitudinal direction of the material as shown in FIGS. 1 to 6. Also, the standard deviation of the carbide orientation degree Oc was not less than 6.0 in the TD cross section, and the dimensional change in the longitudinal direction was reduced compared with that of the material 8. Furthermore, the dimensional change ratio in the longitudinal direction in relation to the width direction was also small, and thus the anisotropy of the dimensional change was also reduced.

Also, the materials 1, 2, and 4 to 6, among the materials 1 to 6 of the present invention, have the standard deviation of the carbide orientation degree Oc in the ND cross section being not less than 10.0, and have small dimensional change ratio in the longitudinal direction through the quenching, and reduced anisotropy of the dimensional change in comparison with the material 3.

The material 2 of the present invention and the material 7 of the comparative example have a same thickness. However, the material 7 was cast slowly compared with the material 2 and a forging ratio of the material 7 in the hot working was larger. Accordingly, the material 7 has a high ratio of the carbides oriented in the longitudinal direction of the material, and a steep slope of a foot of the carbide distribution in FIG. 9. Also, an interval between carbides bands in the "thickness direction" of the material was larger. On the other hand, the material 2 has increased number of irregularly orientated carbides, and gently widened slope of the foot of the carbide distribution in FIG. 9. Also, the interval between carbides bands in "thickness direction" of the material was small.

The invention claimed is:

1. A cold work tool material having an annealed structure extended by hot working and including carbides, the material to be quenched and tempered for use, wherein the material has a composition adjustable to have a martensitic structure by the quenching, and comprises, by mass %, C: 0.80% to 2.40%, Cr: 9.0% to 15.0%, Mo and W alone or in combination in an amount of (Mo+½W): 0.50% to 3.00%, V: 0.10% to 1.50%, Si: not more than 2.00%, Mn: not more than 1.50%, P: not more than 0.050%, S: not more than 0.0500%, Ni: 0% to 1.00%, Nb: 0% to 1.50%, and the balance of Fe and impurities, and wherein, when viewing the annealed structure in a cross section parallel to a direction extended by the hot working and perpendicular to a transverse direction, carbides having a circle equivalent diameter of not smaller than 5.0 μm have a standard deviation of a carbide orientation degree Oc being not less than 6.0, wherein the carbide orientation degree Oc is defined by following equation (1):

$$Oc=D*\theta \quad (1),$$

where D represents a circle equivalent diameter, by μm, of a carbide, and θ represents an angle, by radian, between the extended direction and a major axis of an approximate ellipse of the carbide.

2. The cold work tool material according to claim 1, wherein carbides having a circle equivalent diameter of not less than 5.0 μm have a standard deviation of a carbide orientation degree Oc determined by the equation (1) being not less than 10.0, in viewing the annealed structure of the cold work tool material in a cross section parallel to the direction extended by the hot working and perpendicular to a normal direction.

3. A cold work tool having a martensitic structure including carbides, the martensitic structure being formed by quenching and tempering an annealed structure having been extended by hot working, wherein the tool has a composition adjustable to have the martensitic structure by the quenching, and comprises, by mass %, C: 0.80% to 2.40%, Cr: 9.0% to 15.0%, Mo and W alone or in combination in an amount of (Mo+½W): 0.50% to 3.00%, V: 0.10% to 1.50%, Si: not more than 2.00%, Mn: not more than 1.50%, P: not more than 0.050%, S: not more than 0.0500%, Ni: 0% to 1.00%, Nb: 0% to 1.50%, and the balance of Fe and impurities, and wherein, when viewing the martensitic structure in a cross section parallel to a direction extended by the hot working and perpendicular to a transverse direction, carbides having a circle equivalent diameter of not less than 5.0 μm have a standard deviation of a carbide orientation degree Oc being not less than 6.0, wherein the carbide orientation degree Oc is determined by following equation (1):

$$Oc=D*\theta \quad (1),$$

where D represents the circle equivalent diameter, by μm, of a carbide, and θ represents an angle, by radian, between the extended direction and a major axis of an approximate ellipse of the carbide.

4. The cold work tool according to claim 3, wherein carbides having a circle equivalent diameter of not less than 5.0 μm have a standard deviation of a carbide orientation degree Oc determined by the equation (1) being not less than 10.0, in viewing the martensitic structure of the tool in a cross section parallel to the direction extended by the hot working and perpendicular to a normal direction.

5. A method for manufacturing a cold work tool, comprising a step of quenching and tempering the cold work tool material according to claim 1.

* * * * *